United States Patent [19]

Doubt

[11] Patent Number: 4,592,808

[45] Date of Patent: Jun. 3, 1986

[54] METHOD FOR PLATING CONDUCTIVE PLASTICS

[75] Inventor: Roark M. Doubt, Seattle, Wash.

[73] Assignee: The Boeing Company, Seattle, Wash.

[21] Appl. No.: 633,802

[22] Filed: Jul. 24, 1984

Related U.S. Application Data

[63] Continuation-in-part of Ser. No. 537,497, Sep. 30, 1983, abandoned.

[51] Int. Cl.[4] ..... C25D 5/56; B05D 3/10; B05D 3/12

[52] U.S. Cl. ..... 204/20; 204/30; 427/259; 427/290; 427/306

[58] Field of Search ..... 427/306, 443.1, 305, 427/259, 290; 204/30, 32 R, 224 R, 20; 252/511

[56] References Cited

U.S. PATENT DOCUMENTS

| | | | |
|---|---|---|---|
| 3,093,509 | 6/1963 | Wein | 427/98 |
| 3,438,226 | 4/1969 | Dalpiaz | 68/198 |
| 3,671,285 | 5/1972 | Prescott | 252/511 X |
| 4,038,042 | 7/1977 | Adelman | 428/625 |
| 4,159,934 | 7/1979 | Kadija | 204/224.1 |
| 4,264,646 | 4/1981 | Thornburg et al. | 427/98 |
| 4,353,933 | 10/1982 | Araki et al. | 427/8 |

FOREIGN PATENT DOCUMENTS 200550 12/1982 Japan .

OTHER PUBLICATIONS

"ABS Joins Plastics That Can Be Plated", from the Mar. 1963 issue of C & EN, pp. 48–49.

*Primary Examiner*—Evan K. Lawrence
*Attorney, Agent, or Firm*—Joan H. Pauly

[57] ABSTRACT

A method for plating conductive plastics. The area to be plated is abrasively blasted as necessary to produce suitable mechanical bonding sites. The area is cleaned with a hot alkaline cleaning solution that will not appreciably attack the plastic. The area is sensitized to provide a base for firm adhesion of the metal onto the plastic. Sensitizing a graphite-reinforced epoxy composite preferably includes flowing a dilute solution of hydrochloric acid over the area, flowing a palladium chloride catalyst, rinsing the area, flowing a stannous accelerator, and rinsing the area again. Striking is then carried out by flowing an electroless plating solution over the area to provide a preliminary deposit of metal. The electroless solution may be either copper or nickel. The flowing of each solution is done at a very low velocity to ensure effective and even action on the entire area. Following striking, a plating buildup is provided as required. The plating buildup may be accomplished by continuing the electroless plating process, immersing the area and carrying out electrolytic plating, or brush plating the area. Whatever plating method is chosen, steps must be taken to protect against overheating of the conductive plastic.

18 Claims, 1 Drawing Figure

METHOD FOR PLATING CONDUCTIVE PLASTICS

RELATED APPLICATIONS

This application is a continuation-in-part of applicant's copending application Ser. No. 537,497, filed Sept. 30, 1983, abandoned, and entitled Method for Plating Conductive Plastics. This application is also related to a companion application of the present applicant, entitled Method For Brush Plating Conductive Plastics, Ser. No. 537,723, filed Sept. 29, 1983, U.S. Pat. No. 4,481,081.

1. Technical Field

This invention relates to methods for plating conductive plastics and, more particularly, to such a method that provides good adhesion and complete coverage and that does not require immersion of the part to be plated.

2. Background Art

In recent years, there has been a steadily increasng interest in the use of composite materials in the aircraft industry. In particular, much effort has been directed toward developing technology for producing and using components made from conductive plastics, such as graphite-reinforced composites. There are a number of situations in which it is desirable to plate a component made from such a composite material. These situations include those in which electronic structures are to be housed inside the composite component and in which it is necessary to protect the electronic structures from electromagnetic interference and electromagnetic pulses. Other situations in which there is a need for plating a composite component include those situations in which it is desired to ground the component and those situations in which it is desired to provide protection for the component against corrosion or abrasion.

Known methods for applying plating to conductive plastics require immersing the component into a tank of plating solution. Such methods are unsuitable for components that are too large to be immersed and for many components that are assemblies. Immersion of assembly components is generally not acceptable since the solutions tend to collect and remain in the spaces between the parts of the assembly. This can cause corrosion of the parts and could also possibly interfere with the functioning of the component and surrounding components. Immersion of large conductive plastic components is also relatively expensive to carry out and requires large quantities of plating solution.

Another problem associated with plating conductive plastics like graphite/epoxy composites is that, in electroplating processes, it is necessary to use very low current densities to get the process started and lay down the initial layer of plating. The current density must be kept at a very low level because higher current densities would tend to overheat the plastics and thereby damage them and/or the plating on them. Conventional electroplating processes generally require current densities that are unacceptably high for use with conductive plastics like graphite/epoxy composites and, therefore, are unsuitable for plating on such conductive plastics.

The plating of nonconductive plastics is discussed in an article entitled "ABS Joins Plastics That Can Be Plated" on pages 48 and 49 of the Mar. 25, 1963 issue of C & EN. The article describes a process developed by Enthone, Inc. of New Haven, Connecticut, in which a thin initial film of copper is deposited by electroless plating and then conventional electroplating procedures are used to deposit heavier coatings of metal. The initial steps of surface activation and electroless plating are carried out by immersion of the article into appropriate solutions. As stated in the article, one of the limitations of the process is size, with the process at the time of the writing of the article being confined to barrel finishing. The article also very briefly discusses an all electroplating process developed by Carr Fastener Company, a division of United-Carr Fastener Corporation of Cambridge, Mass. It is stated that the Carr process is limited to quite small articles and to the plating of the entire article.

U.S. Pat. No. 4,038,042, granted July 26, 1977, to R. L. Adelman discloses a process for direct electroplating of plastic articles. The main focus of the patent is providing a plastic with filler materials in set proportions in order to make direct electroplating possible. This is done instead of depositing a film of metal on a nonconductive plastic in order to provide a conductive surface for electroplating.

U.S. Pat. No. 3,093,509, granted June 11, 1963, to S. Wein discloses a process for forming a copper film on glass, plastic and similar materials. The process includes the use of a "sensitizing" solution, a "supersensitizing" solution, and an aqueous alkaline coppering solution comprising copper in chelated form. The sensitizing solution is preferably a tin salt solution and is applied by "dipping, sponging, spraying, or any similar techniques". In the description of specific examples, it is "applied" and "allowed to stand". The preferred method of applying the supersensitizing solution (preferably a palladium salt in an acid solution) is spraying. The coppering solutions are described as being "poured" on the sensitized and supersensitized surfaces.

Japanese Pat. No. 57-200550, ddated December 1982, discloses a non-electrolytic plating process in which the article to be plated is immersed in a non-electrolytic plating solution. The plating process is speeded by passing an electric current through the solution, using electrodes immersed in the solution but kept out of contact with the article being plated. U.S. Pat. No. 4,264,646, granted Apr. 28, 1981, to D. D. Thornburg et al discloses a method of depositing a metal pattern on the surface of a laminar film. The process involves masking areas not to be plated, catalyzing the unmasked areas, removing the masking, and immersing the film in an electroless plating bath. U.S. Pat. No. 3,438,226, granted Apr. 15, 1969, to J. A. Dalpiaz discloses a process in which a plastic tube is plated with a metal coating. U.S. Pat. No. 4,353,933, granted Oct. 12, 1982, to K. Araki et al discloses a method for controlling an electroless plating bath. U.S. Pat. No. 4,159,934, granted July 3, 1979, to I. V. Kadija discloses a brush applicator for use in brush plating.

The above patents and other literature and the prior art that is discussed and/or cited therein should be studied for the purpose of putting the present invention into proper perspective relative to the prior art.

DESCRIPTION OF THE INVENTION

The subject of this invention is a method of plating metal onto conductive plastic. An example of such a plastic is a composite material that includes a matrix material reinforced with a fibrous conductive material. According to an aspect of the invention, the method comprises cleaning the area to be plated with a cleaning solution that will not appreciably attack the plastic. The area is then sensitized to provide a base for firm adhesion of the metal to be electrolessly plated onto the plastic. The sensitizing includes flowing a catalyst solution over the area at a velocity sufficiently low to allow the catalyst solution to act on the area effectively and evenly and flowing an accelerator solution over the area at a velocity sufficiently low to allow the accelerator solution to act on the area effectively and evenly. After sensitizing, striking said area is carried out by flowing an electroless plating solution over said area at a velocity sufficiently low to allow metal in the plating solution to plate evenly onto said area and keeping said area wet with said plating solution until said area is essentially completely covered. The area is then plated to the desired thickness.

The method may further comprise the initial steps of cleaning the conductive plastic to remove any surface oil or grease, and masking areas not to be plated. One way in which the initial step of cleaning may be accomplished is by flowing hot alkaline cleaning solution over the portions of the plastic to be cleaned, and recycling the cleaning solution. If the area to be plated does not have suitable mechanical bonding sites for plating, the method may further comprise abrading the area to be plated by abrasive blasting following any required masking and before cleaning said area prior to sensitizing said area. The abrasive blasting produces suitable mechanical bonding sites.

The step of cleaning the area to be plated preparatory to sensitizing preferably comprises flowing hot alkaline cleaning solution over the portions of the plastic to be cleaned, and recycling the cleaning solution. Similarly, the step of striking preferably comprises flowing the electroless plating solution over the area to be plated, and recycling the plating solution.

An advantage of the present invention is that following sensitizing, an electroless nickel plating solution may be applied immediately without first providing an initial layer of copper, which is necessary when conventional plating processes are used. This dispensing with the initial layer of copper has the advantages of speeding up the process and of cutting down the cost of the process. In addition, it reduces the chances of corrosion caused by copper contacting graphite in the presence of moisture or by the presence of too many dissimilar materials. When the step of striking comprises wetting the area to be plated with an electroless nickel plating solution, it may be preferable to very briefly apply a very low current to said area to initiate coverage of said area with nickel, especially when it is desired to speed up the process.

According to a preferred aspect of the invention, the step of sensitizing the area to be plated comprises flowing a dilute solution of hydrochloric acid over said area. While the area is still wet with this dilute solution, a palladium chloride catalyst is flowed over the area. The area is then double rinsed with cold water. Following rinsing, a stannous accelerator is flowed over the area. The area is then rinsed again in cold water and kept wet until the striking step is initiated. Preferably, each rinsing of the area to be plated during the sensitizing process comprises flowing water over the area to be plated.

The step of plating the area to the desired thickness may be carried out in a number of ways. One alternative is to continue to flow the electroless plating solution over the area until the desired thickness has been achieved. Another alternative for carrying out the step of plating to the desired thickness is to brush plate said area. If brush plating to obtain the desired buildup is used, the method preferably further comprises preparing a cathode lead contact point before initiating the brush plating, including plating said contact point to approximately 0.1 mil. A third alternative way of carrying out the step of plating to the desired thickness involves the immersing of the area to be plated in an electroplating solution. Therefore, the third alternative is only appropriate when there is no objection to immersing the component being plated. The third alternative for carrying out plating to the desired thickness comprises making cathode lead contact at at least one contact point, immersing the area to be plated in a plating solution, applying a very low current of about 2 amps for a short period of about 4 minutes, moving the contact point, and increasing the current while keeping it sufficiently low to prevent burning at the contact point.

Methods conducted according to the invention have the significant advantage of not requiring any immersion of the component being plated into any sort of solution. Thus, the method of the invention is suitable for plating components too large to be immersed in a tank and for plating assembly components which should not be immersed. In addition, the method is relatively portable, making it possible for the method to be carried out in a variety of locations. For example, an aircraft component may be plated on an airfield without removing the component from the aircraft. Moveover, the flowing technique of the invention is generally faster and less expensive than immersion.

By use of a method conducted according to the invention it is possible to accomplish very good adhesion to a variety of surfaces, including as-cast surfaces and machined surfaces. It is also possible to obtain very good coverage of the area to be plated and to accomplish essentially crack-free plating. Another advantage of methods conducted according to the invention is that it is possible to strike with an electroless nickel plating solution, as discussed above. The method of the invention is highly versatile and may be used to plate virtually any surface of a conductive plastic. Whether the initial surface is as-cast or machined, the final result of plating in accordance with the invention is a strongly bonded high quality plated surface.

These and other features and advantages will become apparent from the detailed description of the best mode for carrying out the invention that follows.

BEST MODE FOR CARRYING OUT THE INVENTION

Figure 1:
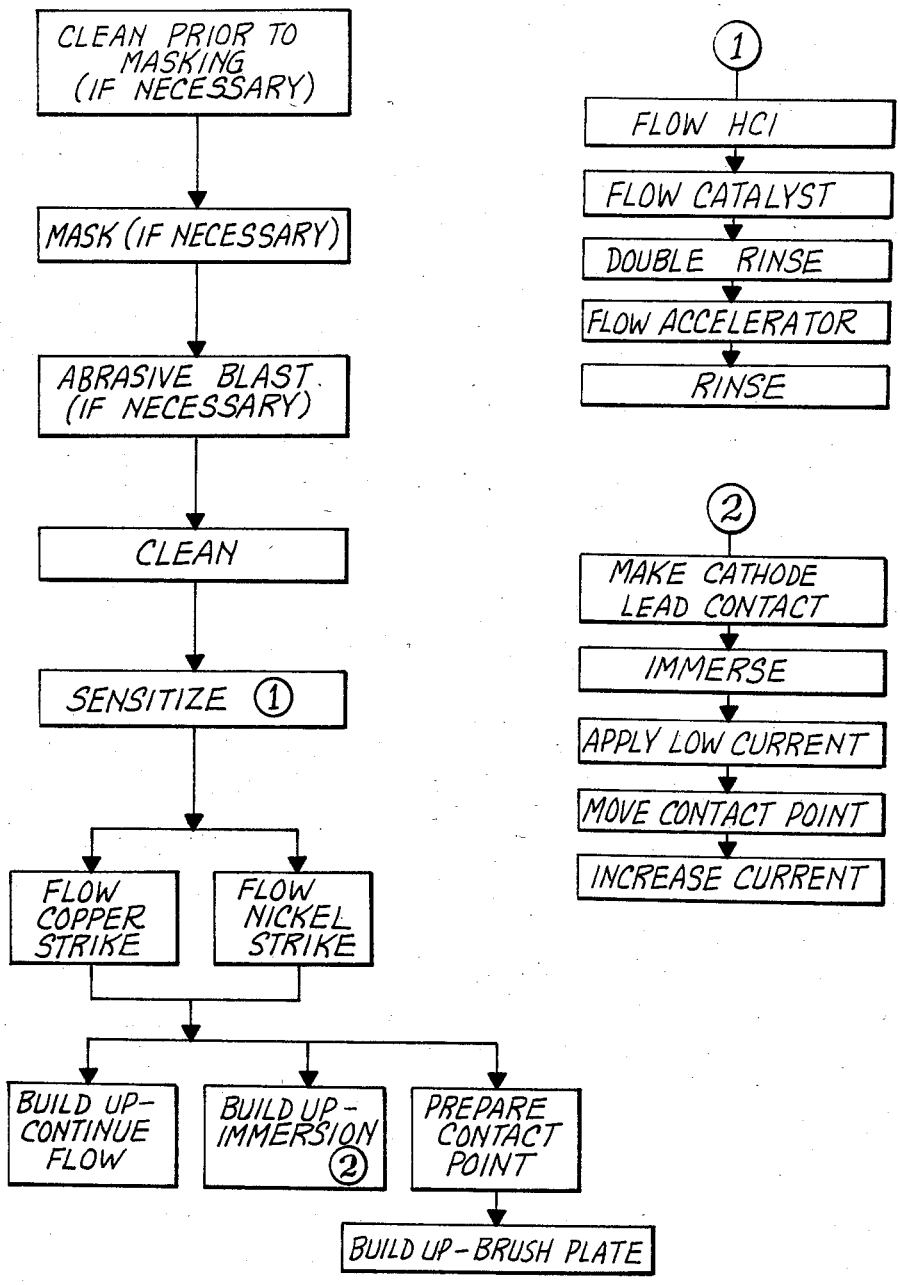
FIG. 1 is a flow chart showing the steps of the preferred embodiment of the invention.

The method of the present invention may be used to great advantage to plate on essentially any conductive plastic, including graphite-reinforced composites. (In this description, the term "conductive plastic" is intended to include both any plastic which is itself conductive and any composite containing a conductive material.) One type of such composites is graphite-reinforced epoxy composites. The following detailed description of the preferred embodiment of the method of the invention is specifically directed toward plating on graphite-reinforced epoxy composites, but it is of course to be understood that the method of the invention may be applied to other types of conductive plastics without departing from the spirit and scope of the invention as defined in the claims.

If the conductive plastic component to be plated is oily or greasy, the first step in the plating process is to clean the surfaces of the component, or at least the surfaces which are to be plated or which must be protected from the plating solution, to remove any surface oil or grease. The cleaning process is carried out using a solvent or solution which does not appreciably attack epoxy. Preferably, the initial cleaning process is carried out with a hot alkaline cleaning solution. The solution may be applied manually or, if the configuration or size of the component make manual cleaning difficult, the solution may be flowed or pumped over the surfaces to be cleaned. The flowed or pumped solution may be recycled. Following the initial cleaning, areas which are not to be plated and which may be exposed to plating solution during the plating process should be masked. Any of a large number of known masking processes may be used. These include using a masking tape and painting, spraying, or dipping the maskant onto the component.

After carrying out the initial cleaning and masking steps or after determining that these intitial steps are unnecessary, the area to be plated is abraded by abrasive blasting to produce suitable mechanical bonding sites. The abrasive blasting may be carried out using a variety of materials, including 180 to 240 grit aluminum oxide at 60 to 100 pounds per square inch gauge as necessary to remove the surface epoxy layer. During the abrasive blasting, care must be taken to avoid excessive abrasive blasting which could reduce the gauge of the composite material. In most cases, when the area to be plated has been machined through the weave layers, the step of abrasive blasting is omitted since suitable mechanical bonding sites are already present. When a type of conductive plastic other than a graphite-reinforced epoxy composite is being plated, the step of abrasive blasting may be omitted if the area to be plated includes suitable mechanical bonding sites without the blasting.

After the initial steps of cleaning, masking, and abrading have been carried out or determined to be unnecessary, the area to be plated is cleaned with an alkaline cleaning solution as described above in connection with the initial cleaning process. The area is then sensitized to provide a base for firm adhesion of the metal to be electrolessly plated onto the plastic. When the plastic being plated is a graphite-reinforced epoxy composite, the step of sensitizing is preferably carried out as follows.

The area to be plated is wetted with a dilute solution of hydrochloric acid by flowing said solution over the area. This dilute solution is preferably about 9% hydrochloric acid. The entire area is kept wet with the dilute solution for about 2 to 4 minutes. At the end of this period, without allowing the area to dry, a catalyst is flowed over the area, preferably a palladium chloride catalyst. An example of a suitable catalyst is a solution containing the palladium catalyst sold under the name of Cuposit 9F by the Shipley Company, Inc., of Newton, Mass. The area is kept wet with the catalyst solution for about 2 to 4 minutes. Then the area is rinsed twice with cold water, with each rinse being carried out for approximately 2 minutes. The rinsed area is then wetted with a stannous accelerator for about 2 to 4 minutes by flowing the accelerator over the area. An example of a suitable accelerator solution is a solution of about 17% of the accelerator sold under the name Accelerator 19 by the Shipley Company, Inc. After application of the accelerator, the area is rinsed with cold water for about 2 to 3 minutes. The area is kept wet until the next step is initiated. During the sensitizing process, each wetting and each rinsing of the area to be plated may be carried out by flowing the liquid used for wetting or rinsing over the area to be plated, and each liquid may be recycled to reduce the cost of the operation.

An important feature of the method of the invention is the flowing of the catalyst solution and the accelerator solution at a very low velocity to ensure effective and even action on the entire area to be plated. Each of the solutions is flowed extremely slowly over the area at a velocity sufficiently low to allow the solution to act on the area effectively and evenly. The slow flowing of the catalyst solution allows the catalyst to adhere evenly to the surface of the area. Experiments in which the catalyst solution was sprayed or sponged on the area resulted in spotty rather than smooth and even plating on the area. Flowing the solutions at a very slow rate ensures that sufficient solution is provided to act on the entire area and allows the chemicals in each solution to act evenly on the area without simply being washed away by the solution itself. In addition, flowing, as opposed to spraying or sponging, ensures that there is constant and even contact between the solution and the area throughout the entire period of time during which the solution is being applied. The result is the very high quality plated surface that is a significant advantage of the present invention.

In the preferred embodiment of the invention, each solution that is applied to the area to be plated is recycled to help minimize the cost of the process. This is carried out by positioning a container of the solution below the area to be plated. The solution is pumped out of the container at a very low rate as required to provide the proper flow velocity. The solution is pumped to a location generally above the area to be plated and allowed to flow over the area at the desired velocity and back down into the container. This recycling procedure allows maximum use to be obtained from a given quantity of solution. Crucial concentrations of various chemicals in the solution are monitored to insure that they remain within acceptable ranges, and additional chemicals are added as needed. When the solution in the container can no longer be used, it may be sent to another location for processing to recover valuable chemicals.

In the preferred embodiment, the catalyst solution is prepared as follows. A mixture is prepared including 25% water, 50% dilute hydrochloric acid (35 to 37%), and 25% Cuposit 9F catalyst. The solution is maintained at a pH of about 7. The palladium concentration is controlled to between 0.22 and 0.40 grams per liter. This concentration may be maintained by adding Cuposit 9F concentrate as required. The stannous tin content is between 10 and 50 grams per liter.

The accelerator speeds the deposit of a layer of metal onto the plastic during the next step of striking, described below. The accelerator lays down a layer of tin no more than about one molecule thick. The plating metal readily adheres to this tin layer. The accelerator also protects against catalyst drag into the electroless bath used in the striking process.

Following the sensitizing process, a striking process is carried out to provide a preliminary deposit of the metal being plated on the area to be plated. The striking process is preferably begun without allowing the area to dry following the sensitizing process. This helps prevent contamination of the area. The striking process is accomplished by wetting the area to be plated with an electroless plating solution and keeping the area wet with such plating solution until the area is essentially completely covered with the preliminarly deposit of metal. This wetting of the area is preferably accomplished by flowing the electroless plating solution over the area to be plated. The solution is flowed at a velocity sufficiently low to allow the metal in the solution to plate onto the area evenly over the entire area. Preferably, the solution is recycled in the manner described above to reduce the cost of the plating process. The electroless plating solution may be a copper solution or a nickel solution.

An example of a suitable copper solution is a solution including 72.5% deionized or distilled water, 12.5% of the solution sold by the Shipley Company, Inc., under the name of Electroless Copper Mix 328A, 12.5% of the solution sold by Shipley under the name Electroless Copper Mix 328Q, and 2.5% of the solution sold by Shipley under the name Electroless Copper Mix 328C. The electroless solution prepared by mixing the above in the required proportions is applied to the area to be plated and the area is kept wet with the mixture for about 10 to 20 minutes. Following this time, the area is rinsed with cold water for 2 to 3 minutes.

One of the advantages of the present invention is that nickel may be deposited directly onto the conductive plastic without first providing a layer of copper. When it is desired to apply nickel directly, the striking step is carried out by wetting the area to be plated with an electroless nickel plating solution, such as one which contains a nickel-phosphorus alloy. One example is a solution prepared with Niposit 65 nickel mix, manufactured by the Shipley Company, Inc. The area is kept wet with the nickel solution for about 8 to 15 minutes and then rinsed. When a nickel solution, as opposed to a copper solution, is used, it may be necessary to "jump start" the electroless plating process to initiate the coverage of the area to be plated with the preliminary deposit of nickel. The jump start is accomplished by very briefly, essentially momentarily, applying a very low current to the area to be plated. The current should, of course, be sufficiently low to prevent any overheating or burning of the plastic.

Following the striking process, the desired buildup of copper or nickel on the area is provided by plating the area to the desired thickness. This may be accomplished in a number of ways. One alternative is to continue the electroless plating process by keeping said area wet with th electroless plating solution until the desired thickness has been achieved. This may be done by flowing the electroless plating solution or continuing to flow said solution over the area. When the buildup is accomplished by continuing the electroless plating process, care must be taken to ensure that the solution is replenished as required. This applied to a situation in which the area is immersed in the solution as well as to a situation in which the solution is flowed over the area and recycled.

Although a significant advantage of the present invention is that it does not require immersion of the component being plated at any point in the process, each step that may be accomplished by flowing a solution or water over the area to be plated may also be accomplished by immersing the area to be plated. Such steps of course include the final step of plating to the desired buildup. If immersion plating by electrolytic means is chosen as the means for carrying out this final step, great care must be taken because the composite is conductive and prone to overheat with the passage of excess current. Therefore, conventional immersion plating techniques must be modified in order to prevent burning of the composite at the contact points. The modified immersion plating process is as follows.

Cathode lead contact is made at at least one contact point. The area to be plated is immersed in a suitable plating solution. While the area is immersed, the solution is agitated to minimize temperature and concentration gradients. A very low current, preferably not more than 2 amps per contact, is applied for a short period of about 4 minutes. Then the contact point or points are moved and the plating is continued with an increased current. Of course, the increased current must still be kept sufficiently low to prevent burning of the composite at the contact points. The number of contact points required is determined largely by the size of the area to be plated. On large areas, several contact points, essentially the more the better, are necessary. The use of multiple contact points is known in the art but is especially important when the component being plated is made from a conductive plastic.

A number of different plating solutions may be used to accomplish immersion plating. One example is a copper plating solution of plating grade copper sulphate in a concentration of 24 to 30 ounces per gallon, 96% sulfuric acid in a concentration of 6 to 8 ounces per gallon, and chloride ion in a concentration of 20 to 60 parts per million. The additive sold under the name EK-1H by the Harshaw Chemical Company of Cleveland, Ohio may be used in this solution. This additive contributes to the brightness and smoothness of the surface of the finished product. It tends to smooth down high points and fill in holes so that the final surface is smooth and even.

A third alternative technique for accomplishing the final buildup is to brush plate the area to be plated to the desired thickness. Because conductive plastics are prone to overheat with the passage of current, the cathode lead contact point or points should be prepared before initiating the brush plating process. The preparation includes plating the ar4as chosen as contact points to approximately 0.1 mil at a voltage not exceeding 4 volts. This initial plating of the contact points helps to prevent burning at the contact points and allows the brush plating process to be carried out at a somewhat higher voltage. The total area of the contact point or points depends on the total area to be plated. A larger area to be plated requires a correspondingly larger total contact area in order to avoid burning the conductive plastic. The configuration of the contact point area, apart from its size, is unimportant.

It will obvious to those skilled in the art to which this invention is addressed that the invention may be used to advantage in a variety of situations. Therefore, it is also to be understood by those skilled in the art that various changes, modifications, and omissions in form and detail may be made without departing from the spirit and scope of the present invention as defined in the following claims.

What is claimed is:

1. A method of plating metal onto conductive plastic, comprising:

cleaning the area to be plated with a cleaning solution that will not appreciably attack the plastic;

sensitizing said area to provide a base for firm adhesion of the metal to be electrolessly plated onto the plastic, including flowing a catalyst solution over said area at a velocity sufficiently low to allow the catalyst solution to act on said area effectively and evenly and flowing an accelerator solution over said area at a velocity sufficiently low to allow the accelerator solution to act on said area effectively and evenly;

striking said area by flowing an electroless plating solution over said area at a velocity sufficiently low to allow metal in the plating solution to plate evenly onto said area and keeping said area wet with such plating solution until said area is essentially completely covered; and plating said area to the desired thickness.

2. A method as described in claim 1, further comprising the initial steps of cleaning the conductive plastic to remove any surface oil or grease, and masking areas not to be plated.

3. A method as described in claim 2, in which the initial step of cleaning comprises flowing hot alkaline cleaning solution over the portions of the plastic to be cleaned, and recycling the cleaning solution.

4. A method as described in claim 1, further comprising abrading the area to be plated by abrasive blasting before cleaning said area, to produce suitable mechanical bonding sites.

5. A method as described in claim 1, in which the step of cleaning comprises flowing hot alkaline cleaning solution over the portions of the plastic to be cleaned, and recycling the cleaning solution.

6. A method as described in claim 1, in which the step of striking further comprises recycling said plating solution.

7. A method as described in claim 1, in which the step of striking comprises wetting said area with an electroless nickel plating solution, and very briefly applying a very low current to said area to initiate coverage of said area with nickel.

8. A method as described in claim 1, in which the step of sensitizing comprises:

flowing a dilute solution of hydrochloric acid over said area;

while said area is still wet wtih said dilute solution, flowing a palladium chloride catalyst over said area;

double rinsing said area with cold water;

flowing a stannous accelerator over said area; and rinsing said area in cold water and keeping said area wet until the striking step is initiated.

9. A method as described in claim 8, in which each rinsing of said area during the sensitizng process comprises flowing water over the area to be plated.

10. A method as described in claim 1, in which the step of plating said area to the desired thickness comprises continuing to flow said electroless plating solution over said area until the desired thickness has been achieved.

11. A method as described in claim 1, in which the step of plating said area to the desired thickness is an electrolytic plating step comprising:

making cathode lead contact at at least one contact point;

immersing the area to be plated in a plating solution;

applying a very low current of about 2 amps for a short period of about 4 minutes;

moving the contact point; and increasing the current while keeping it sufficiently low to prevent burning at the contact point.

12. A method as described in claim 1, in which the step of plating said area to the desired thickness comprises brush plating said area.

13. A method as described in claim 12, further comprising preparing a cathode lead contact point before intiating brush plating, including plating said contact point to approximately 0.1 mil.

14. A method of plating metal onto a composite material including a plastic matrix material reinforced with a fibrous conductive material, comprising:

cleaning the area to be plated with a cleaning solution that will not appreciably attack the composite material;

sensitizing said area to provide a base for firm adhesion of the metal to be electrolessly plated onto the composite material, including flowing a catalyst solution over said area at a velocity sufficiently low to allow the catalyst solution to act on said area effectively and evenly and flowing an accelerator solution over said area at a velocity sufficiently low to allow the accelerator solution to act on said area effectively and evenly;

striking said area by flowing an electroless plating solution over said area at a velocity sufficiently low to allow metal in the plating solution to plate evenly onto said area and keeping said area wet with such plating solution until said area is essentially completely covered; and plating said area to the desired thickness.

15. A method as described in claim 14, further comprising abrading the area to be plated by abrasive blasting before cleaning said area, to produce suitable mechanical bonding sites.

16. A method as described in claim 14, in which the step of striking comprises wetting said area with an electroless nickel plating solution, and very briefly applying a very low current to said area to initiate coverage of said area with nickel.

17. A method as described in claim 14, in which the step of sensitizing comprises:

flowing a dilute solution of hydrochloric acid over said area;

while said area is still wet with said dilute solution, flowing a palladium chloride catalyst over said area;

double rinsing said area with cold water;

flowing a stannous accelerator over said area; and rinsing said area in cold water and keeping said area wet until the striking step is initiated.

18. A method as described in claim 14, in which the step of plating said area to the desired thickness comprises preparing a cathode lead contact point, including plating said contact point to approximately 0.1 mil, and then brush plating said area.

* * * * *

UNITED STATES PATENT AND TRADEMARK OFFICE
CERTIFICATE OF CORRECTION

PATENT NO. : 4,592,808

DATED : June 3, 1986

INVENTOR(S) : Roark M. Doubt

It is certified that error appears in the above-identified patent and that said Letters Patent are hereby corrected as shown below:

Column 1, following line 13, insert the following paragraph:

-- The Government has rights in this invention. --

Signed and Sealed this

Twenty-fourth Day of November, 1987

*Attest:*

DONALD J. QUIGG

*Attesting Officer*

*Commissioner of Patents and Trademarks*